US008028459B2

(12) United States Patent
Williams

(10) Patent No.: US 8,028,459 B2
(45) Date of Patent: Oct. 4, 2011

(54) INTEGRATED RAIL SYSTEM AND METHOD FOR MAKING AND USING SAME

(75) Inventor: Nicholas Williams, Turin, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 127 days.

(21) Appl. No.: 12/466,857

(22) Filed: May 15, 2009

(65) Prior Publication Data

US 2010/0287809 A1 Nov. 18, 2010

(51) Int. Cl.
*F41A 35/00* (2006.01)
*F41C 27/00* (2006.01)

(52) U.S. Cl. ..... 42/90; 42/84; 42/85; 42/106

(58) Field of Classification Search ..... 42/90, 71.01, 42/72, 83, 85, 106
See application file for complete search history.

(56) References Cited

U.S. PATENT DOCUMENTS

| | | | | |
|---|---|---|---|---|
| 6,385,892 | B1 * | 5/2002 | Vendetti | 42/86 |
| 6,508,027 | B1 * | 1/2003 | Kim | 42/124 |
| 6,606,813 | B1 * | 8/2003 | Squire et al. | 42/90 |
| 6,779,288 | B1 * | 8/2004 | Kim | 42/72 |
| 6,895,708 | B2 * | 5/2005 | Kim et al. | 42/72 |
| 7,363,741 | B2 * | 4/2008 | DeSomma et al. | 42/85 |
| 7,669,359 | B2 * | 3/2010 | Kim | 42/124 |
| 7,707,762 | B1 * | 5/2010 | Swan | 42/85 |
| 7,765,730 | B2 * | 8/2010 | Keng | 42/111 |
| 7,775,150 | B2 * | 8/2010 | Hochstrate et al. | 89/193 |
| 7,793,452 | B1 * | 9/2010 | Samson et al. | 42/72 |
| 2003/0106252 | A1 * | 6/2003 | Hines | 42/90 |
| 2004/0103577 | A1 * | 6/2004 | Compton | 42/85 |
| 2005/0000142 | A1 * | 1/2005 | Kim et al. | 42/124 |
| 2006/0065112 | A1 | 3/2006 | Kuczynko et al. | |
| 2009/0044439 | A1 * | 2/2009 | Phillips et al. | 42/72 |

FOREIGN PATENT DOCUMENTS

WO WO-2005047801 A2 5/2005

OTHER PUBLICATIONS

ISA/US International Search Report and Written Opinion of the International Searching Authority dated Jul. 15, 2010 (8 pgs).

* cited by examiner

*Primary Examiner* — Bret Hayes
*Assistant Examiner* — Joshua Freeman
(74) *Attorney, Agent, or Firm* — Harris Beach PLLC

(57) ABSTRACT

Embodiments of the application can include an integrated rail system construction for a firearm with transverse ribs or tabs (e.g., picatinny rail) to include an undercut or slot at a front and/or rear face to cooperate with mounting structure for a detachable accessory. Embodiments of a rail structure can include a channel to pass wires used to power accessories mounted to the rail. Embodiments of the application can include methods for manufacturing an integral rail system.

16 Claims, 13 Drawing Sheets

INTEGRATED RAIL SYSTEM AND METHOD FOR MAKING AND USING SAME

FIELD OF THE INVENTION

This application relates to accessories for firearms. More particularly, embodiments according to this application relate to rail systems that may include one or more accessory rails.

BACKGROUND OF THE INVENTION

An operator must grip a firearm on or adjacent the barrel to stabilize the firearm during operation. Rail systems can be provided to attach accessories that are available to aid in the proper or enhanced operation of firearms. Further, rail systems can prevent items from directly attaching to the barrel, which can alter the barrel slightly and can adversely affect the accuracy of the firearm. Also, rail systems can protect the hand from the heat of the barrel.

Rail systems and/or firearm accessories add weight to the firearm. Accessories and/or accessory mounting devices need to mount securely to the rail systems and certain accessories need power to operate. Further, rail systems and/or accessory mounting devices must be constructed ruggedly and to withstand heavy use. In addition, rail systems and/or accessory mounting devices need to be cheap, fast, simple, and accurately manufactured.

SUMMARY OF THE INVENTION

Accordingly, it is an object of this application, to address in whole or in part, at least the foregoing and other deficiencies in the related art.

It is another object of this application, to provide in whole or in part, at least the advantages described below.

It is an object of this application to provide a rail system for a firearm, accessory rail, and/or methods for making and using the same. It is an object of this application to provide a rail system including more secure accessory mounting and methods thereof. It is an object of this application to provide an integral rail system and/or method of manufacturing. It is an object of this application to provide a rail system having a power supplied accessory mounting system and methods thereof. It is an object of this application to provide a rail system having longitudinal conduit channels that are disposed internal to a rail system to increase protection and methods thereof.

BRIEF DESCRIPTION OF THE DRAWINGS

Novel features that are characteristic of the embodiments of the application are set forth with particularity in the claims. The application itself may be best be understood, with respect to its organization and method of operation, with reference to the following description taken in connection with the accompanying drawings in which:

DESCRIPTION OF EMBODIMENTS

Figure 1:
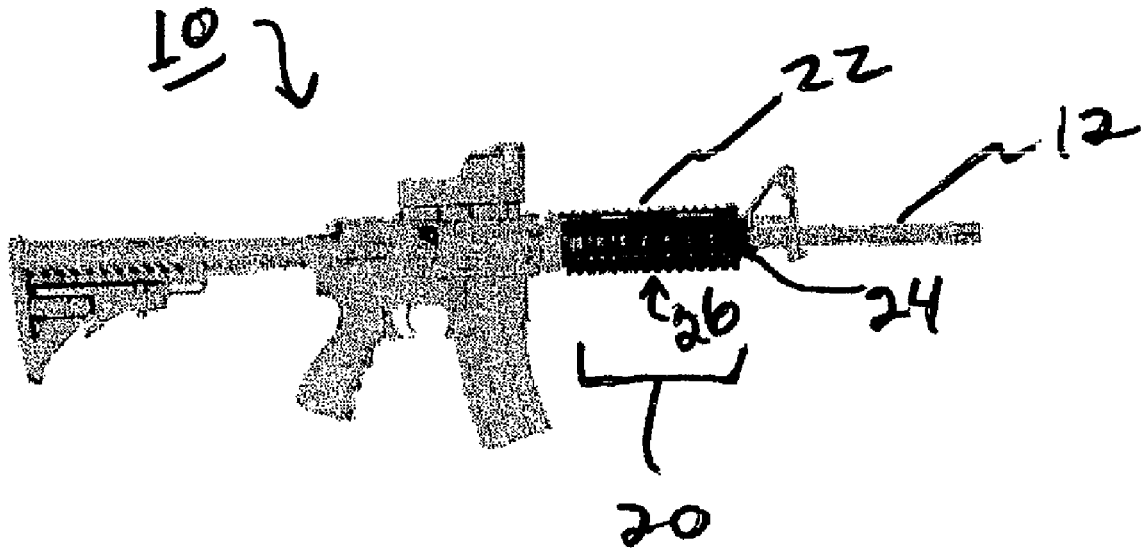
FIG. 1 is a diagram that shows a perspective exterior view of an exemplary firearm and rail system.

Referring to FIG. 1, firearm 10 has a barrel 12 extending from an exemplary rail system 20. Rail system 20 can include top rail 22, side rails 24, and bottom rail 26. Rail system 20 can be mounted on firearm 10 by various structures and methods known to one skilled in the art. Rail system 20 can be an integrated accessory rail system that can be extruded as a single piece having each element integrally formed therewith. As described herein, "unitary" describes a construction where all of the components are extruded integrally or as a single piece or in a continuous simultaneous manufacturing process. Such unitary construction can increase strength and simplify manufacturing. Alternatively, rail system 20 can be manufactured in a plurality of pieces and assembled before or assembled simultaneously when mounting directly or indirectly to firearm 10. While rail system 20 can be mounted on a rifle as shown in FIG. 1, embodiments of the application are not intended to be so limited. For example, rail system 20 can be mounted on substantially any firearm.

Any or all of top rail 22, side rails 24, and bottom rail 26 can be referred to herein as "rail assembly." Additionally, while top rail 22, side rails 24, and bottom rail 26 are illustrated carried by rail system 20, some, or all may be omitted as desired. Additionally, unique structures of the rail assembly described herein can be used on any firearm without the use of a hand guard or in conjunction with other hand guard systems. Rails, accessory rails, and/or various rail assemblies described herein such as rail system 20 (and/or rail system 30, rail system 1130 described below) adhere to all the critical dimensions of MIL-STD 1913, and/or Picatinny rail, which is hereby incorporated by reference in its entirety.

Figure 2:
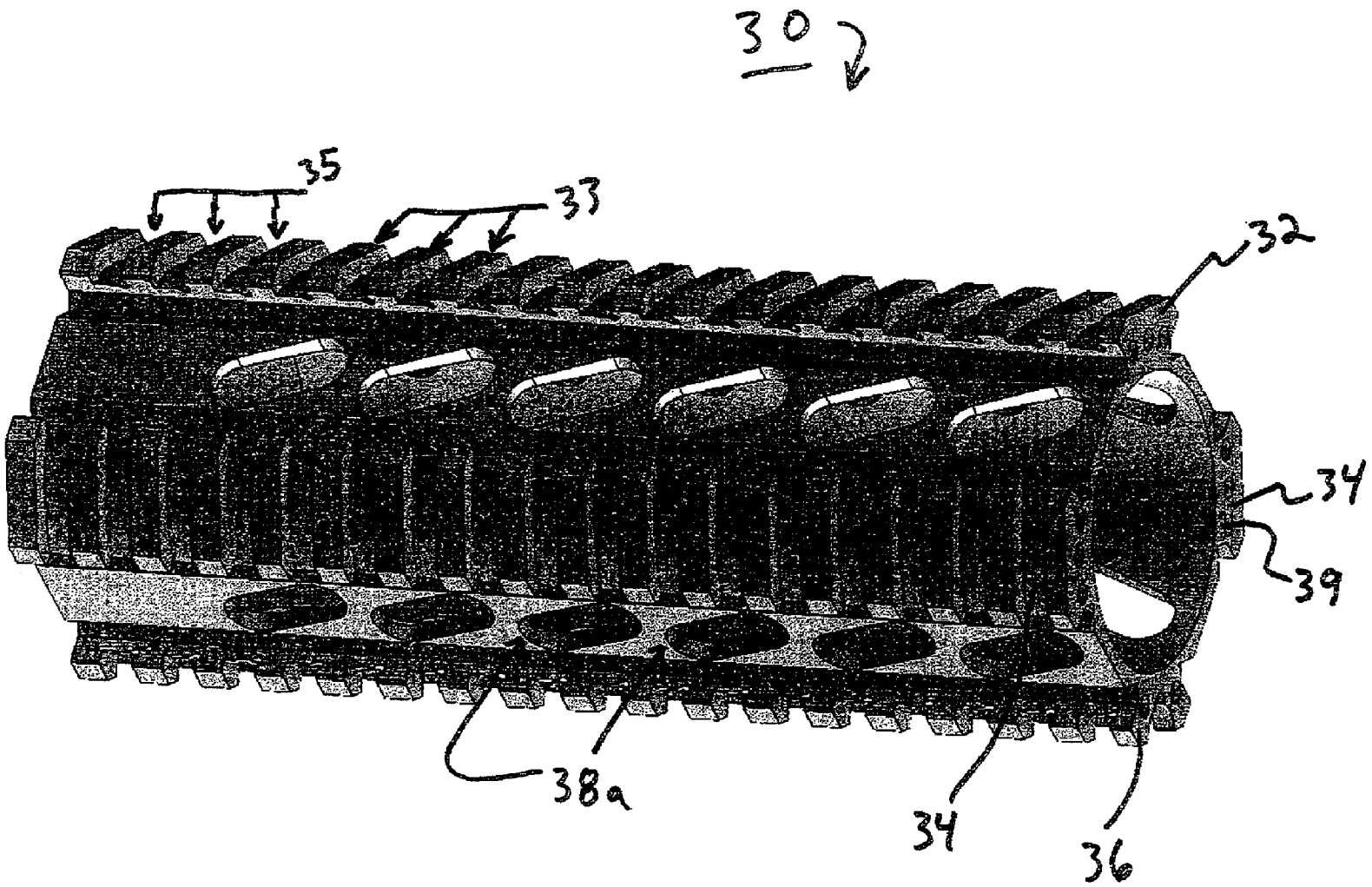
FIG. 2 is a diagram that shows a perspective exterior view of exemplary rail system for use with a firearm according to an embodiment of the application.

Referring now to FIG. 2, an exemplary rail system 30 according to one embodiment can include top accessory rail 32, side accessory rails 34, or bottom accessory rail 36. The following descriptions of exemplary rail system 30 include a description of the various accessory rails. Those skilled in the art will understand that rail system 30 can be used without accessory rails, and conversely, accessory rails can be employed on other rail systems, hand guard systems, or firearms in general. Rail system 30 can include a tubular body 38 that can be spaced from, but surround or cover a portion/majority of barrel 12 of a firearm. Tubular body 38 can be fabricated of metal, such as aluminum or plastics as known to one skilled in the art. Tubular body 38 may be fabricated, for example, by extrusion and subsequent milling. In one embodiment, top accessory rail 32, side accessory rails 34, and bottom accessory rail 36 are extruded with tubular body 38 in a unitary piece. Top accessory rail 32 can be formed manufactured with tubular body 38 and can be used to mount rail system 30 to firearm 10 (e.g., at an upper mount of firearm 10). Rail system 30 can, for example, engage a barrel nut of barrel 12 for support. Alternative or additional support can be provided to rail system 30 and/or top accessory rail 32, if present. Further, it is understood that alternative structures known to one skilled in the art can attach rail system 30 to a firearm. Thus, rail system 30 can be supported in a spaced relationship to barrel 12 to allow air flow therebetween.

In the event that one or all of top accessory rail 32, side accessory rails 34, or bottom accessory rail 36 are used without tubular body 38, they may be attached to a firearm using another rail system or by structures other than a rail system (e.g., attachment rings, hand guards, or other mounting devices). As described herein, structure mounting one or all of the top accessory rail 32, side accessory rails 34, and/or bottom accessory rail 36 can be included in the "mounting structure," which is intended to include any structures mounting one or all of the top accessory rail 32, side accessory rails 34, or bottom accessory rail 36 on a firearm, including tubular body 38. Further, one or all of top accessory rail 32, side accessory rails 34, and bottom accessory rail 36 and the mounting structure for the rails can be considered to be in the "rail system" as described herein.

Referring to FIG. 2, openings 38*a* (e.g., longitudinal slots) can be formed in tubular body 38, between top accessory rail 32, side accessory rails 34, and bottom accessory rail 36 to reduce weight and/or increase air flow between tubular body 38 and the firearm and/or barrel 12. As shown in FIG. 2, the removal of material does not substantially weaken the overall structure of unitary rail system 30.

A plurality of equally spaced transverse ribs 33 can be formed on a portion, a majority, or substantially the entire length of top accessory rail 32, side accessory rails 34, and/or bottom accessory rail 36 separated or interspaced by a plurality of corresponding recesses 35. Transverse ribs 33 can be used to mount accessories to a firearm and can reduce or prevent movement (e.g., forward and rearward) of accessories attached thereto.

With reference to FIGS. 2-8, the weight of rail system 30 can be further reduced by removing material from the accessory rails. For example, additional openings 38*b* can be formed through accessory rails and tubular body 38. Openings 38*a* can be formed crossing or within accessory rails. In one embodiment, longitudinal openings 38*b* are formed in bottom accessory rail 26, but not formed in top accessory rail 32 (see FIG. 7).

Figure 3:
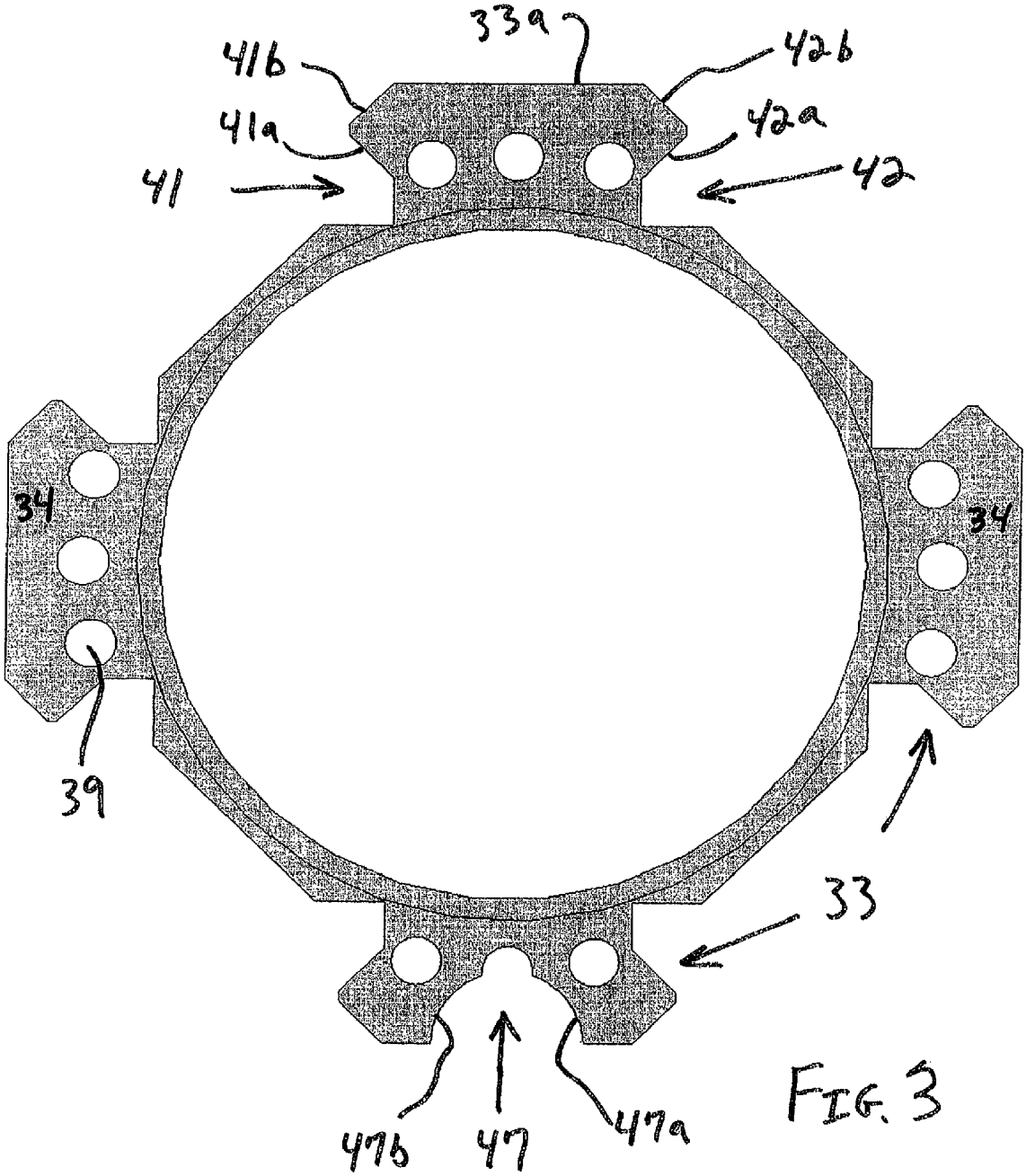
FIG. 3 is a diagram that shows a front end view of an exemplary rail system shown in FIG. 2.

Referring to FIG. 3, a front view of rail system 30 is illustrated. Top accessory rail 32 and side accessory rails 34 are substantially identical; therefore, only top accessory rail 32 will be described in detail herein. Bottom accessory rail 36 is similar to top accessory rail 32 but includes a central longitudinal groove 47 and/or openings 38*b*.

Referring to FIG. 3, top accessory rail 32 can include at least first (e.g., lower) external referencing surfaces 41 and 42, which can be defined by opposing longitudinal side cuts or grooves 41 and 42, respectively. Second (e.g., upper) external referencing surfaces 41*b* and 42*b* adjoin first external referencing surfaces 41*a* and 41*b*. A third (e.g. top) referencing surface 33*a* can join second referencing surfaces 41*b* and 42*b*. Additional external or internal referencing surfaces may be included for an accessory rail. For example, optional internal referencing surfaces 47*a* and 47*b* can be defined by central longitudinal cut or groove 47.

Figure 4:
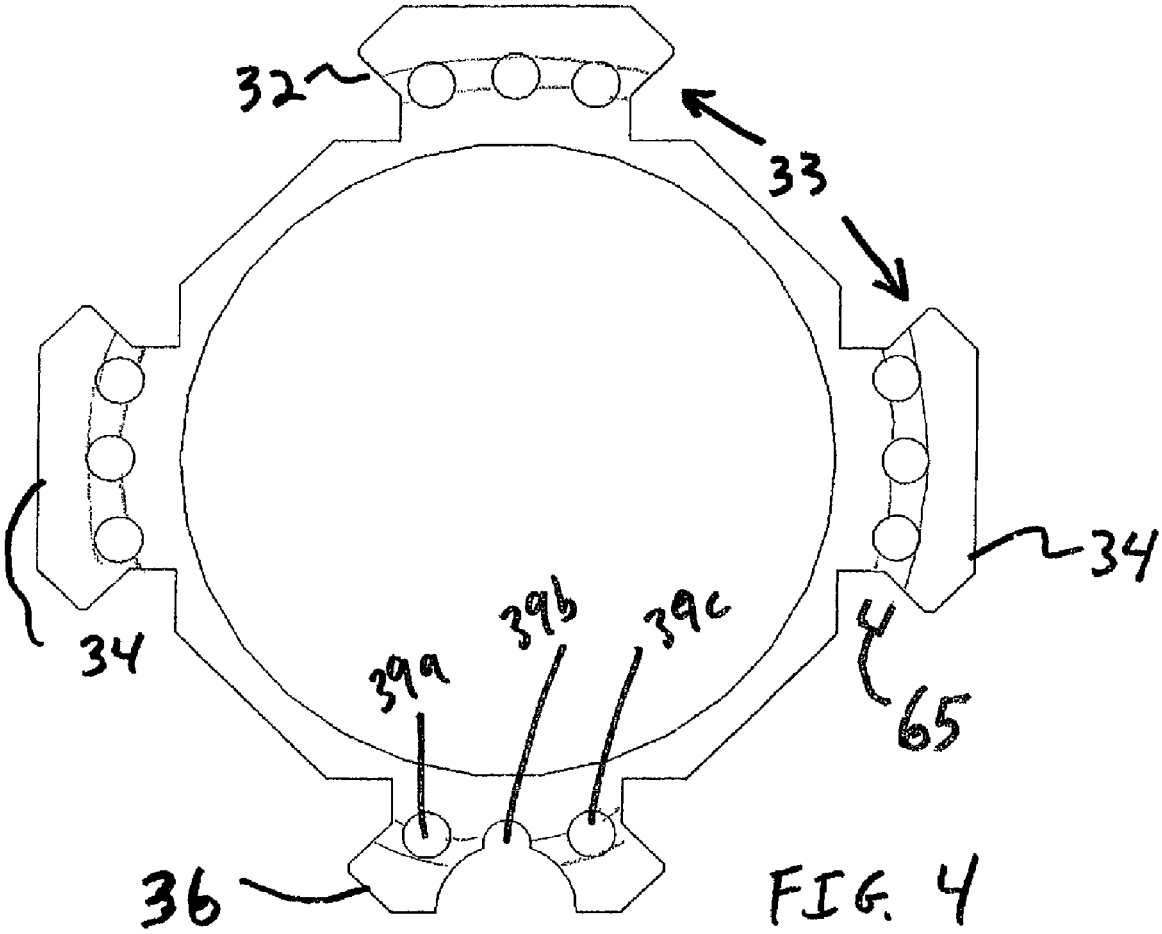
FIG. 4 is a diagram that shows a back end view of an exemplary rail system shown in FIG. 2.

Referring to FIG. 4, a rear lateral view of rail system 30 is illustrated. In top accessory rail 32, side accessory rails 34, or bottom accessory rail 36, one or more longitudinally extending conduits (e.g., passageways, tubes) 39 can be provided. In one embodiment, electrical conduits 39 can pass through one or more of ribs 33, recesses 35, tubular body 38 and/or longitudinal slots 38*a*, 38*b*. Further, conduits 39 can pass through at least one transverse rib 33, a plurality of transverse ribs 33, a majority of transverse ribs 33, or all transverse ribs 33 in a corresponding accessory rail. In one embodiment, conduits 39 provide passage for one or more electrical connections to provide power to accessories mounted on top accessory rail 32, side accessory rails 34, and/or bottom accessory rail 36. For example, electrical cabling can be coated in epoxy and passed or strung through the conduits 39 and the epoxy can subsequently harden.

Referring to FIG. 4, conduits 39 are shown in an even radial configuration relative to a longitudinal axis of tubular body 38. Further, conduits 39 can be provided in a substantially horizontally aligned configuration. Alternatively, one or more of the conduits 39 in an accessory rail may be provided at different heights, different radial distances, offset in a vertical or radial perspective, or stacked in a vertical or radial perspective.

Referring to FIG. 4, conduits 39 are shown having circular substantially equal cross-sections. However, embodiments of the application are not intended to be so limited. For example, the conduits 39 can be provided with oval cross-sections, rectangular cross-sections, polygonal cross-sections, or non-linear cross-sections to match an intended or desired use. Further, conduits 39 can be unequal in size. In one embodiment, a size of conduit 39 longitudinally changes. Conduits 39 can pass through an equal or different number of ribs 33 in respective accessory rails 32, 34, and/or 36. Further, within one accessory rail, conduit units 39*a*, 39*b*, and/or 39*c* can pass through an equal or different number of ribs 33.

Figure 5:
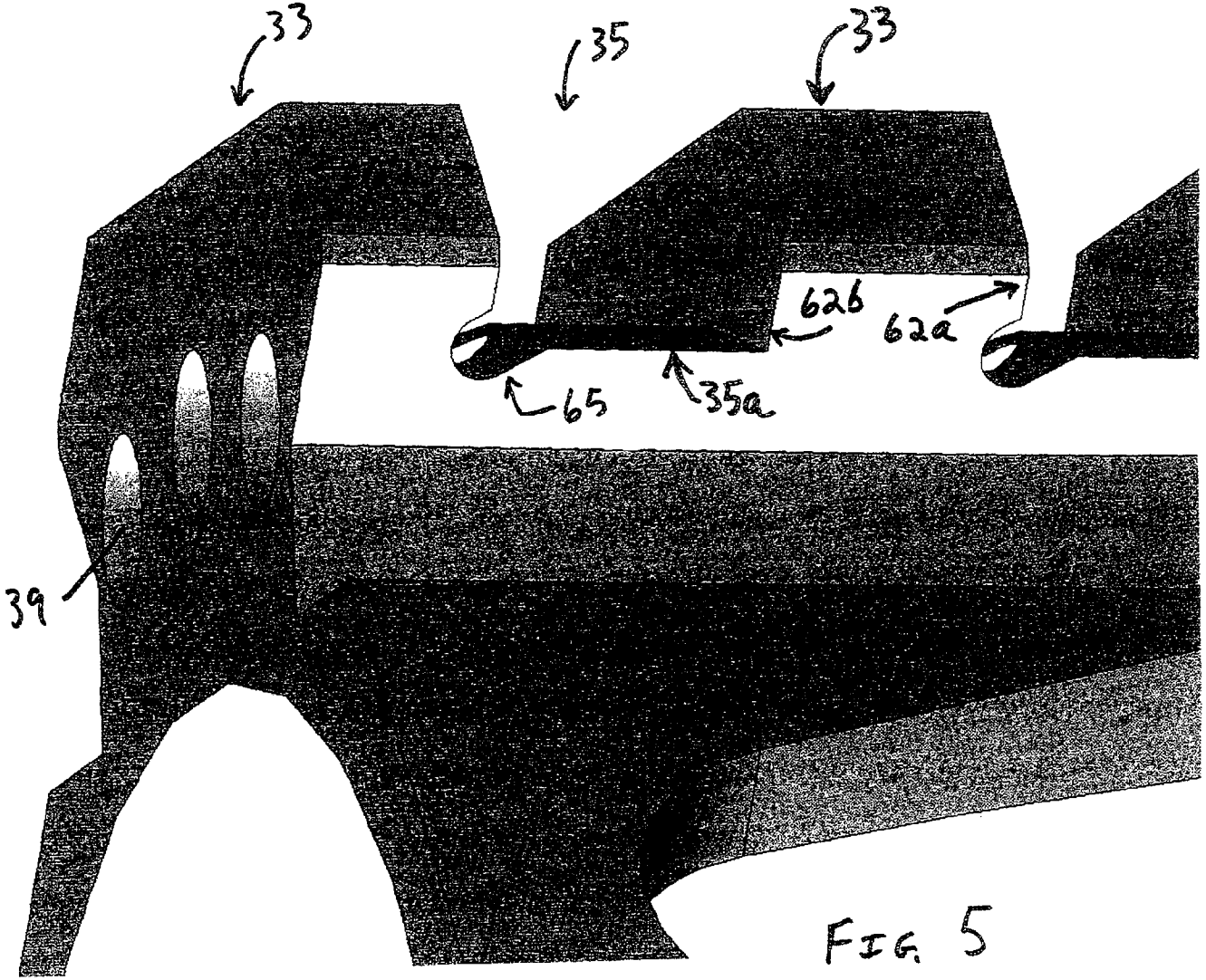
FIG. 5 is a diagram that shows a perspective side view of an exemplary anchor slot in the exemplary rail system shown in FIG. 2.

Referring to FIG. 5, transverse ribs 33 can include surfaces 62, which can be used to mount accessories. Surfaces 62 can be substantially vertical and can include first lateral surfaces and second opposing lateral surfaces 62*b* (e.g., forward lateral surfaces and back lateral surfaces 62*b*). In one embodiment, anchor slots or recesses 65 can be formed on surfaces 62 (e.g., between transverse ribs 33 along each accessory rail).

Referring to FIG. 5, anchor slots 65 can be formed to provide additional interior surfaces to reduce or prevent movement (e.g., longitudinal, lateral, or radial movement) of accessories attached to transverse ribs 33. In one embodiment, anchor slots 65 are formed only at all or selected first lateral surfaces 62*a*. However, embodiments of the application are not intended to be so limited. For example, in one embodiment, anchor slots 65 are provided only at all or selected rear lateral surfaces 62*b*. Alternatively, anchor slots 65 may be provided in corresponding pairs, one each in opposing lateral surfaces 62*a* and 62*b*, respectively, with a prescribed number of ribs 33 (e.g., 1 to N) therebetween.

As shown in FIG. 5, anchor slots 65 can remove material lower than a bottom surface of recess 35 and above bottom surface 35*a* of recess 35. In addition, anchor slots 65 can remove a portion of bottom surface 35*a* of recess 35. Anchor slots 65 can be within one surface of recess 35. For example, anchor slots 65 can be provided entirely in a bottom surface 35*a*.

Dimensions and locations of anchor slots 65, according to embodiments of the application are intended to provide additional mounting surfaces and/or access to conduits 39. For example, anchor slots 65 can provide at least one recessed surface relative to lateral surface 62 of transverse ribs 33 (e.g., to mount accessories thereto).

Figure 6:
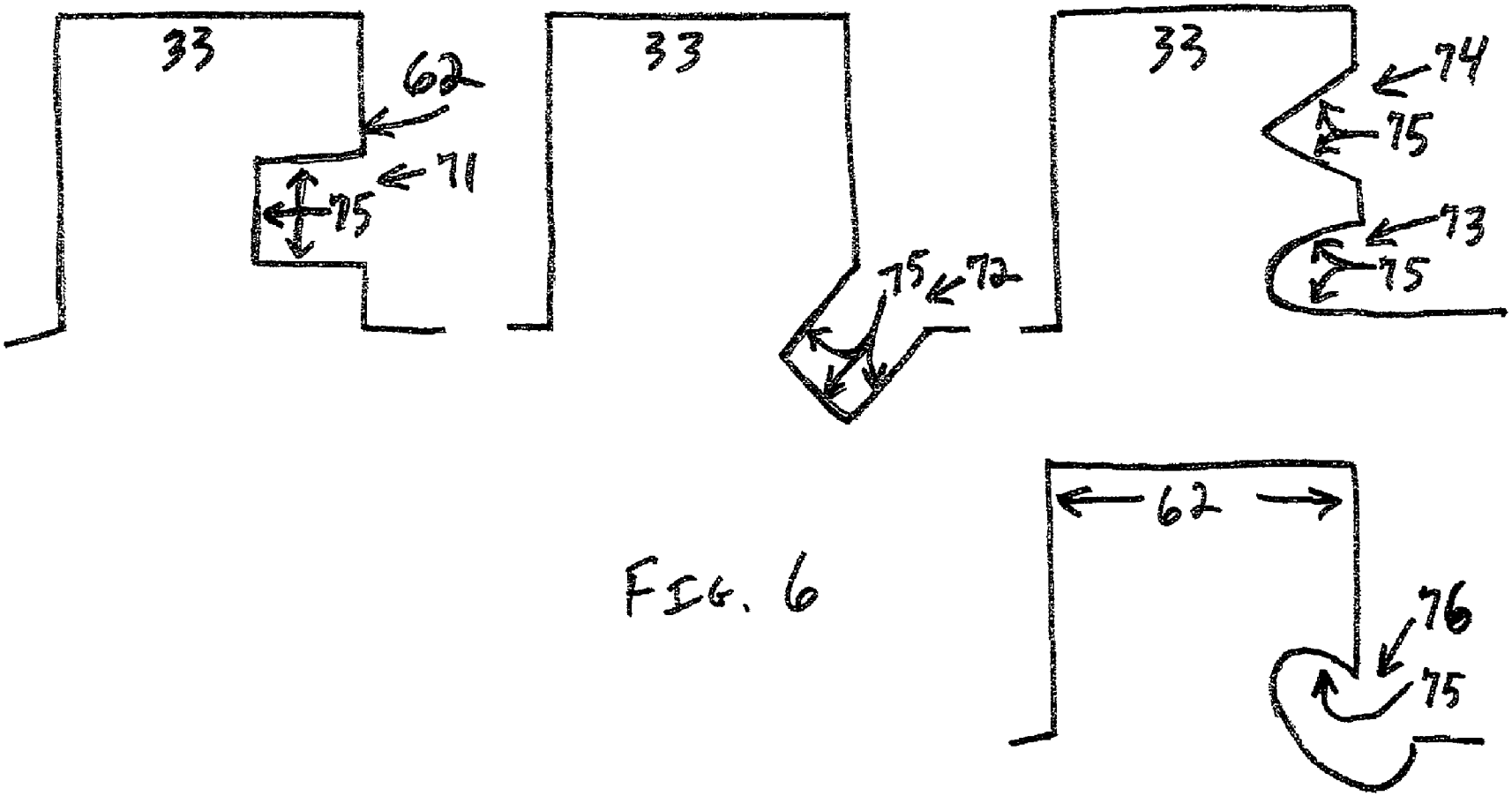
FIG. 6 is a diagram that shows side views of exemplary anchor slots according to an embodiment of the application.

Referring to FIG. 6, exemplary embodiments of anchor slots 71, 72, 73, 74, and 76 provide at least one recessed engagement surface 75. Anchor slots 71, 72, 73, 74, and 76 are intended to be exemplary and not to limit embodiments of this application.

In one embodiment, a cross-section of anchor slots 65 can operate to secure a mounted accessory. For example, a shoulder or radial lip can provide an engagement surface matched to engage a protruding or engaging surface of mounting structure of an accessory.

Recessed engagement surfaces 75 can be provided for a detachable frictional fit or press-fit interface with a corresponding engaging surface on a mounted accessory. For example, a frictional fit or press-fit can be used between recessed engagement surface 75 and a corresponding engaging surface of a mounted accessory.

In one embodiment, engagement surfaces 75 in lateral face 62*a* can combine with an additional surface on rail system 30 such as adjacent lateral face 62*b* to simultaneously engage a first portion and a second portion of a mounting structure of an accessory when that accessory is mounted to rail system 30. For example, in a ski-boot type arrangement, the first portion of the accessory mount can engage anchor slots 65 in lateral face 62*b* while the second portion of the accessory mount can subsequently lock in place against opposing lateral face 62*a*. Further, other combinational arrangements can be used, for example, cooperatively or forcibly engaging the first and second portions of an accessory mount at multiple separate engagement positions (e.g., in an opposing pair of anchor slots 65 in a recess 35).

Figure 7:
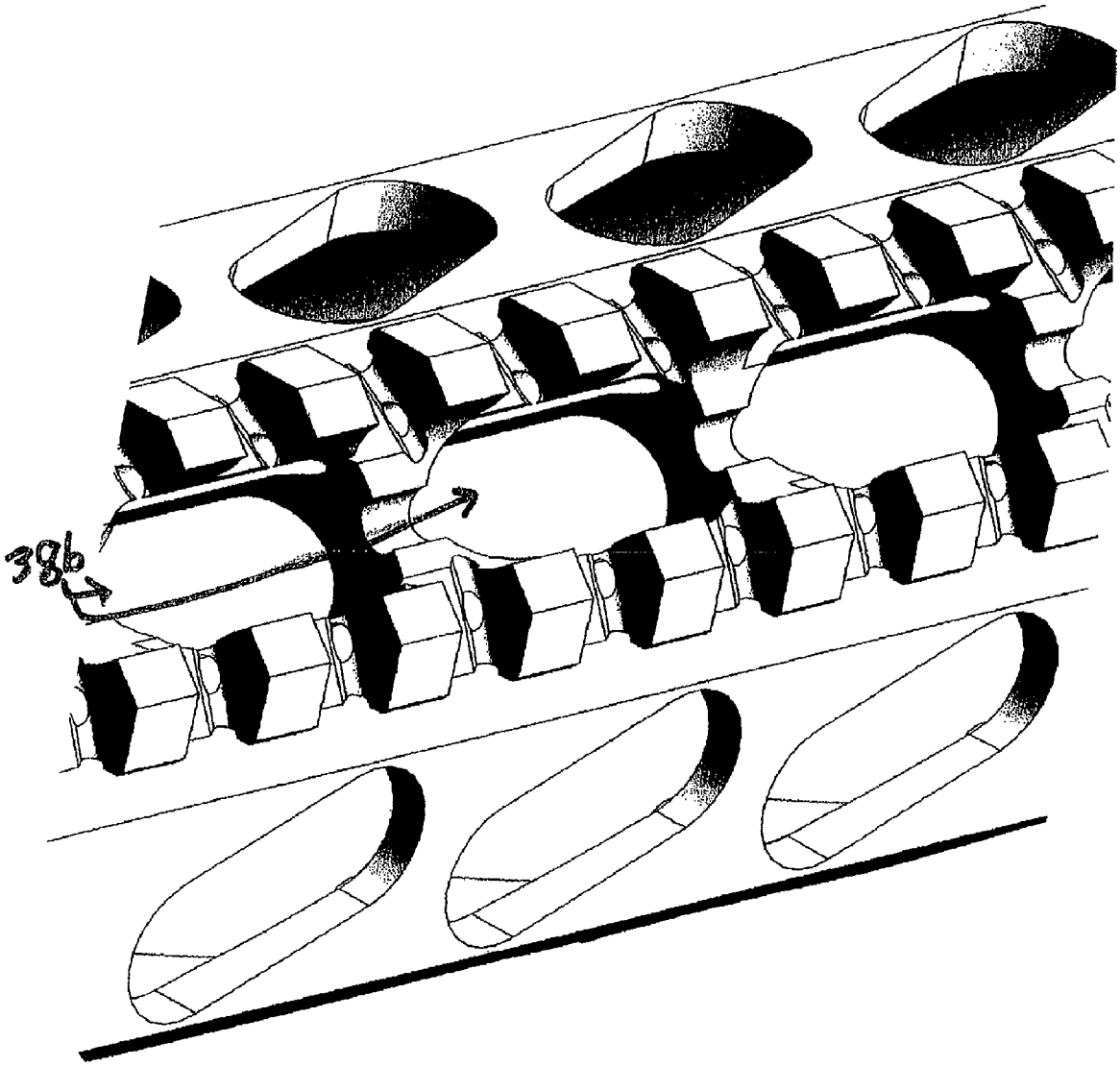
FIG. 7 is a diagram that shows another perspective exterior view of an exemplary rail system shown in FIG. 2.

Referring to FIG. 7, conduits 39 can be accessed in one embodiment at each rib 33 through which conduits 39 passes using corresponding anchor slots 65 and/or recess 35. Embodiments of the application are not intended to be limited to such access to conduits 39. For example, as further shown in FIG. 7, conduits 39 can be accessed using a corresponding longitudinal slot 38*b*. Conduits 39*a*, 39*b*, and 39*c* can provide covered, secured, or internal passage though rail system 30.

As described herein, it should be understood that bottom accessory rail 36 is substantially similar to accessory rails 32 and/or 34 with the addition of central groove 47. It is understood that central groove 47 can be used, as desired, with top accessory rails 32 and/or side accessory rails 34. It is understood further, in one embodiment, central groove 47 can have a different cross-section (e.g., stepped, angled, tiered, or the like) to provide additional internal referencing surfaces.

Figure 8:
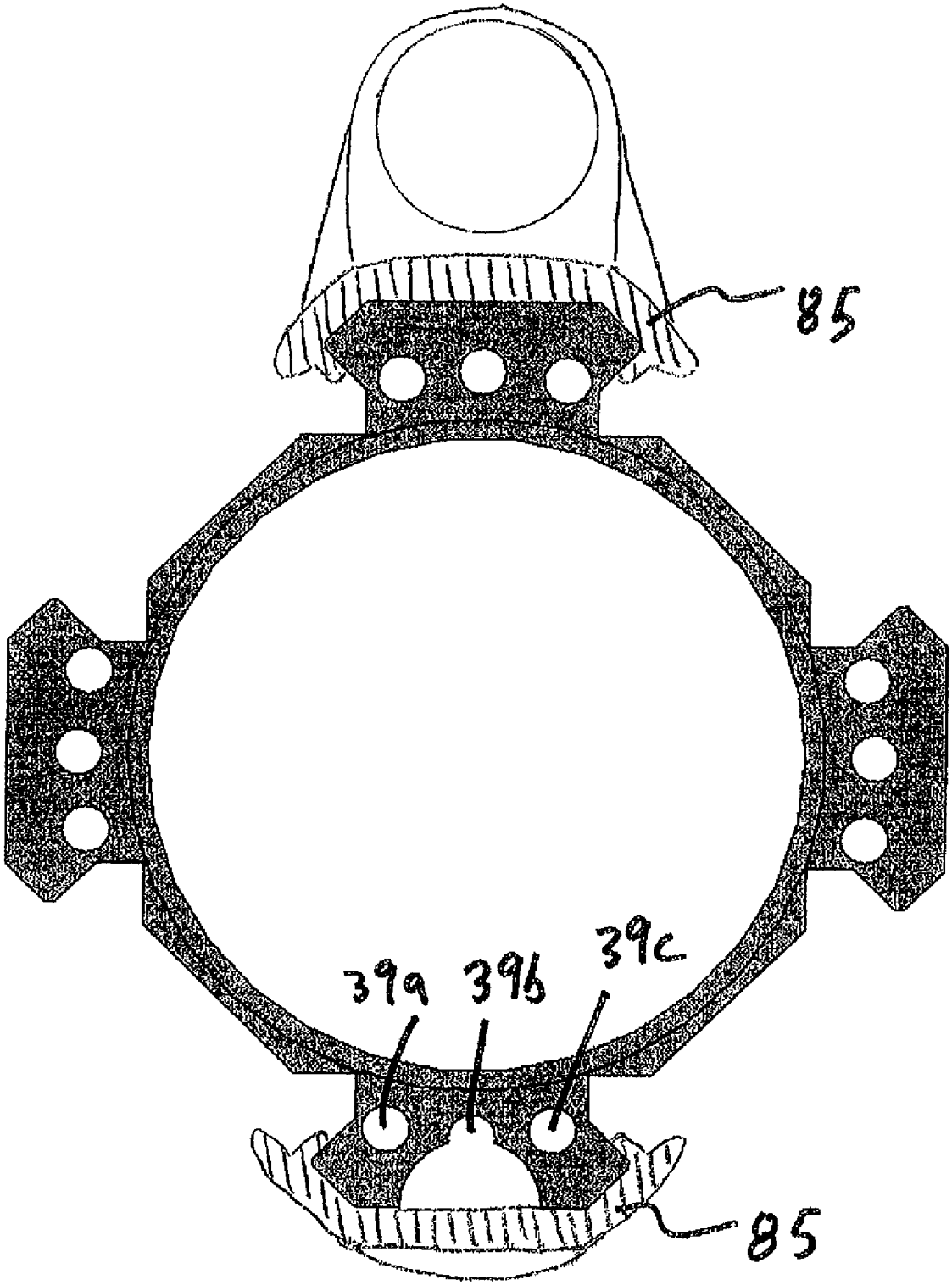
FIG. 8 is a diagram that shows a front end view of the exemplary rail system shown in FIG. 2.

Referring to FIG. 8, exemplary accessory mounting structure 85 is illustrated coupled to top accessory rail 32 and bottom accessory rail 36. Accessory mounting structure 85 can also be affixed to side accessory rails 34. Accessories can be detachably held by one or more of external referencing surfaces 41*a*, 41*b*, 42*a*, 42*b* or internal referencing surfaces 47*a*, 47*b*. Various types of accessory mounting structures known to one skilled in the art can be used with rail system 30.

Since conduits 39 can provide passage for one or more electrical connections (e.g., insulated cables) to provide power to accessories mounted on the top accessory rail 32, side accessory rails 34, and/or bottom accessory rail 36, power need not be provided by each mounted accessory itself. In one embodiment, rail system 30 can provide multiple power supplies for multiple mounted accessories. By carrying a battery storage system or power supply system at or attached to an individual using a firearm, the weight of the firearm can be reduced and accuracy in using the firearm can be increased. In addition, using an external power supply and storage system, rail system 30 can allow extra power supplies to be carried for a plurality of mounted accessories mounted to top accessory rail 32, side accessory rails 34, and/or bottom accessory rail 36.

Figure 9:
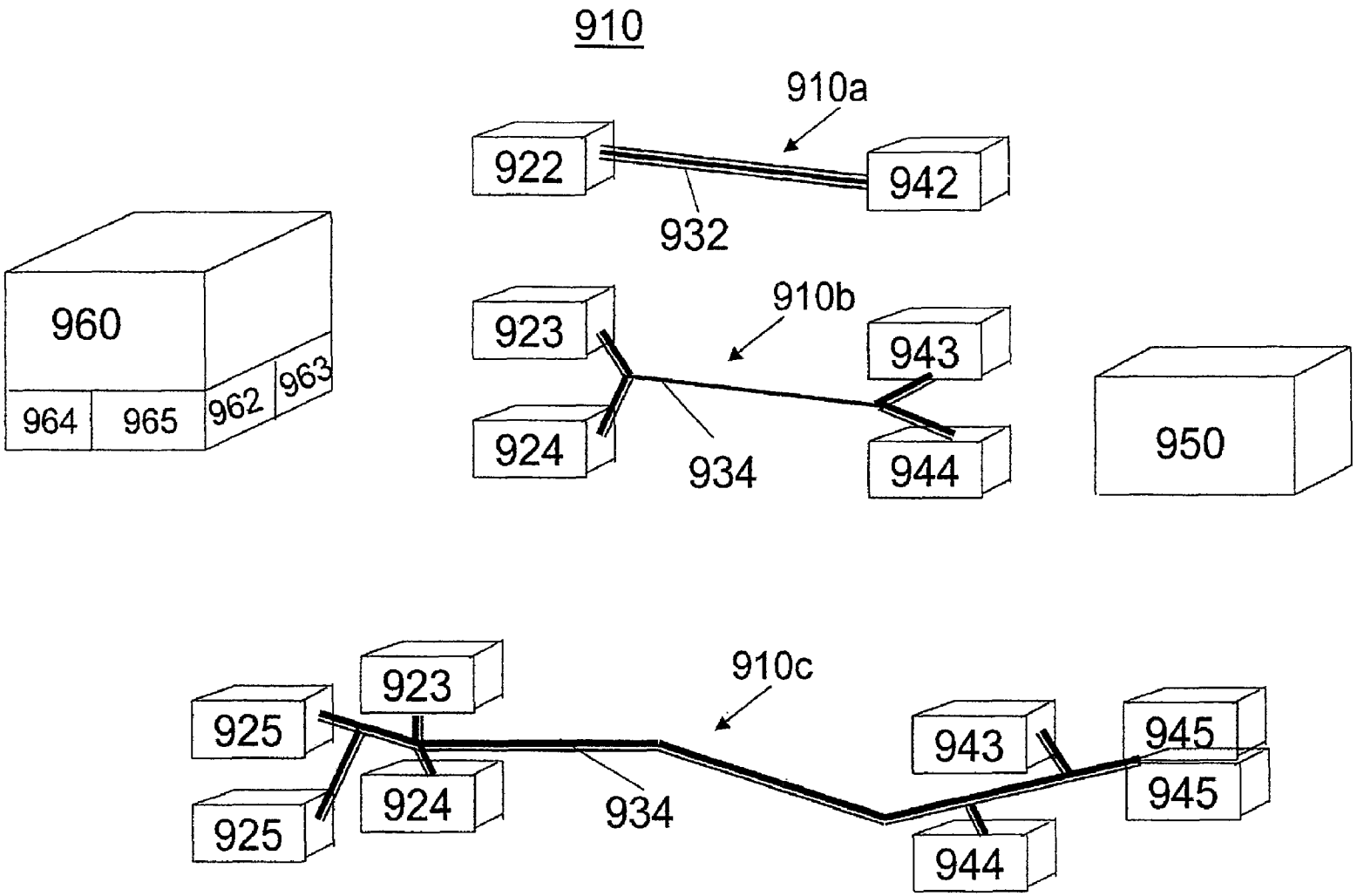
FIG. 9 is a diagram that that shows exemplary rail mount accessory electrical cables according to one exemplary embodiment.

Referring to FIG. 9, exemplary rail assembly electrical cables 910 are illustrated. In one embodiment, rail assembly electrical cable 910 can provide an electrical coupling between an external battery power supply and storage unit 960 and at least one external accessory 950 mounted to top accessory rail 32, side accessory rails 34, or bottom accessory rail 36. For example, rail assembly electrical cable 910*a* can include first adaptor 922, electrical connection unit 932, and accessory power adaptor 942. Rail assembly electrical cable 910*b* can include second adaptor 923 and third adaptor 924, dual electrical connection unit 933 and second and third accessory power adaptors 943 and 944. Further, rail assembly electrical cable 910*c* can include second adaptor 923, third adaptor 924 and two fourth adaptors 925, multi-electrical connection unit 935, and second accessory power adaptor 942, third accessory power adaptor 943 and two fourth accessory power adaptors 945. It is understood other configurations for rail assembly electrical cable 910 can be used according to embodiments of the application.

Since mountable accessories for firearms can require different power supplies or batteries, rail mount accessory electrical cable 910 in combination with rail system 30 can be adapted for use with but not limited to multiple mountable accessories such as lights, lasers and night vision equipment that can have identical or different power supply requirements. For example, mountable accessories can use different battery types such as Aimpoint-type batteries, AAA type batteries, AA type batteries, rechargeable type batteries, or 123 series Lithium batteries. In one embodiment, power supply and storage unit 960 can include a plurality of externally or internally accessible different terminal adaptor types 962, 963, 964, and 965 corresponding to (e.g., connecting) adaptor types 922, 923, 924, and 925. Power supply and storage unit 960 can further include environmentally protected storage (e.g. water, dust, and rattle-resistant sealed cavity) having an external access cover for carrying reserve electrical power supplies or batteries. In one embodiment, the power supply and storage unit 960 can be exterior to rail system 30 and carried by an individual or located at a position of the firearm that can have reduced or no interference with proper operation of the firearm.

In one embodiment, exemplary rail assembly electrical cables 910 can supply multiple different reference voltage levels on insulated wires affixed in one conduit unit (e.g., conduit unit 39*a*) or in each of conduit units 39*a*, 39*b*, 39*c*, respectively. For example, a first reference voltage, a second reference voltage, and a third reference voltage can be provided through conduit units 39*b*, 39*a*, and 39*c*, respectively. Exemplary voltage levels can include 0 volts, 5 volts, 10 volts, or 12 volts. Further, insulated access to the different voltage levels in conduits 39 or conduit units 39*a*, 39*b*, and 39*c* can be provided using anchor slots 65.

Figure 10:
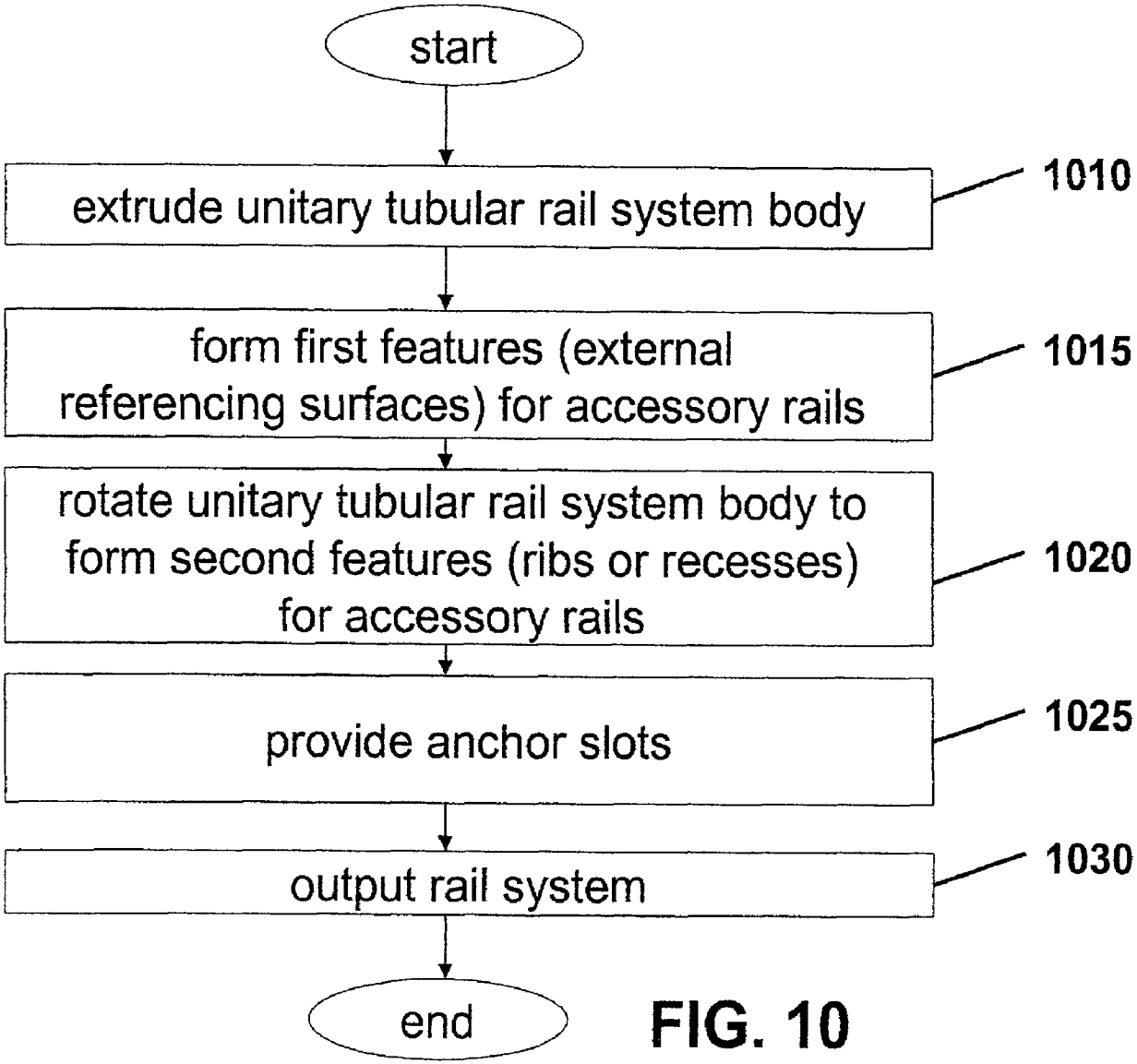
FIG. 10 is a diagram that shows a flowchart of an exemplary method to make a rail system according to an embodiment of the application.

Referring to FIG. 10, a flowchart of an exemplary method for manufacturing an integrated rail system according to embodiments of the application will now be described. The method for making the integrated rail system of FIG. 10, will be described using and can be applied to rail system 30; however, the method of FIG. 10 is not intended to be limited to rail system 30.

Referring to FIG. 10, after a process starts, a unitary tubular rail system body can be extruded as a single integral piece as known to one skilled in the art. Rail system unitary body can include rail accessory protrusions (e.g. top, side, and bottom) (block 1010).

Milling operations can then be used to form desired surfaces/features such as exterior and optional interior referencing surfaces on rail accessory protrusions. For example, longitudinal cuts (e.g., up or down) as known to one skilled in the art can form outer and central grooves such as grooves 41, grooves 42, and grooves 47. Further, other milling operations can be used to form holes (e.g., openings 38*a*) to reduce mass or weight of the unitary tubular rail system body. For example, longitudinal slots 38*b* may be formed between the rail accessory protrusions (block 1015).

In one embodiment, conduits extending longitudinally though rail system unitary body are formed in block 1015. Alternatively, such conduits can be subsequently formed in rail system unitary body by additional later milling operations.

Selected dimensions (e.g., critical dimensions) of accessory rails can have reduced or limited error tolerances. For example, selected accessory rail dimensions are intended for use with accessories to be subsequently mounted thereon. Thus, it is desirable that dimensions used in mounting accessories such as slot width, slot spacing, rib width and/rib spacing (e.g., picatinny rails) be accurate.

In one embodiment, recesses are formed in rail accessory protrusions (e.g., to determine longitudinally spaced ribs) by rotating unitary tubular rail system body (e.g., 200 revolutions per minute, 500 revolutions per minute, 700 revolutions per minute, 1,000 revolutions per minute, 5,000 revolutions per minute, or 10,000 revolutions per minute) about its longitudinal axis. Rotating rail system unitary body can be directed against a stationary manufacturing material removing tool. By rotating the unitary tubular rail system body to form recesses 35, dimensions of slot width, slot spacing, rib width and/rib spacing can be controlled (e.g., increased accuracy) (block 1020). In one embodiment, opposing vertical lateral walls used to determine one slot or recess can have increase accuracy from a bottom surface to a top surface thereof. For example, accuracy in such slot/rib dimensions can be increased by 1%, 3%, 5% or more.

In one embodiment, a bottom surface of recesses formed between opposing lateral faces have a curved surface (e.g., a convex surface when viewed from a front/back perspective). The curvature of a bottom surface between opposing lateral faces can be related to the radial size of rail system unitary body. Reduced debris in the recess can result because the curved or sloped bottom surface can trap fewer debris and/or previously trapped debris will be forced or urged out of the recess by the slope or curvature.

Anchor slots can then be formed in lateral faces of rail accessory protrusions by rotating unitary tubular rail system body (e.g., 400 revolutions per minute) about its longitudinal axis against a braced stationary manufacturing material removing tool. By rotating the unitary tubular rail system body to form the anchor slots, dimensions of anchor slot can be controlled (block 1025). In one embodiment, a plurality of anchor slots can be formed over each other in lateral faces of ribs in accessory rails. In one embodiment, anchor slots 65 are formed in the bottom surface of recesses 35.

In one embodiment, cross-sections of the anchor slots can be circular, oval, parabolic, stepped, polygonal, non-linear, include at least one right angle or the like. In addition, controlled spacing for a plurality of recesses 35 for two or more accessory rails can be provided.

In block 1030, conversion of the unitary tubular rail system body into a rail system can be completed. For example, additional desired surfaces may be milled. Further, for example, insulated electrical lines (wires) may then be disposed in conduits of the unitary tubular rail system body. Alternatively, electrical lines may be disposed in conduits during or after block 1010. In one embodiment, multiple lines may be disposed in a single conduit or in a single accessory rail where each conduit can have a different voltage level (e.g., ground voltage, first higher accessory voltage level, second different accessory voltage level). Further, in one embodiment, insulators may be provided to cover exposed electrical lines in conduits 39 in recesses 35 where accessories will not electrically connect thereto. Alternatively, insulators may be provided to cover exposed electrical lines at selected anchor slots 65 where accessories will not electrically connect.

From block 1030, a process can end. Although, described in sequence, it is understood that operations described in the method of FIG. 10 can be performed in various sequences or in parallel.

Figure 11A:
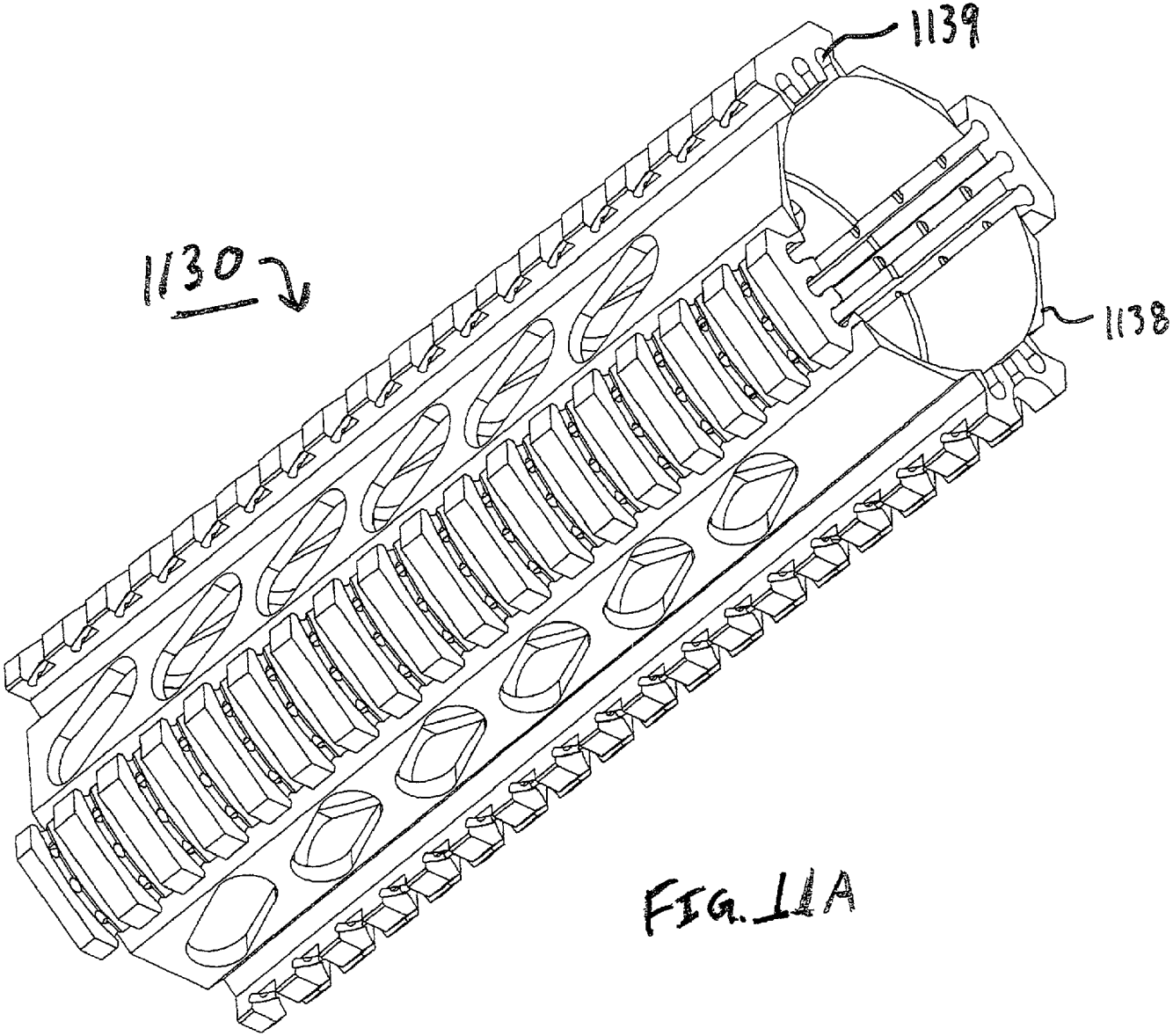
FIGS. 11A and 11B are diagrams that show an embodiment of a rail system according to the application.
Figure 11B:
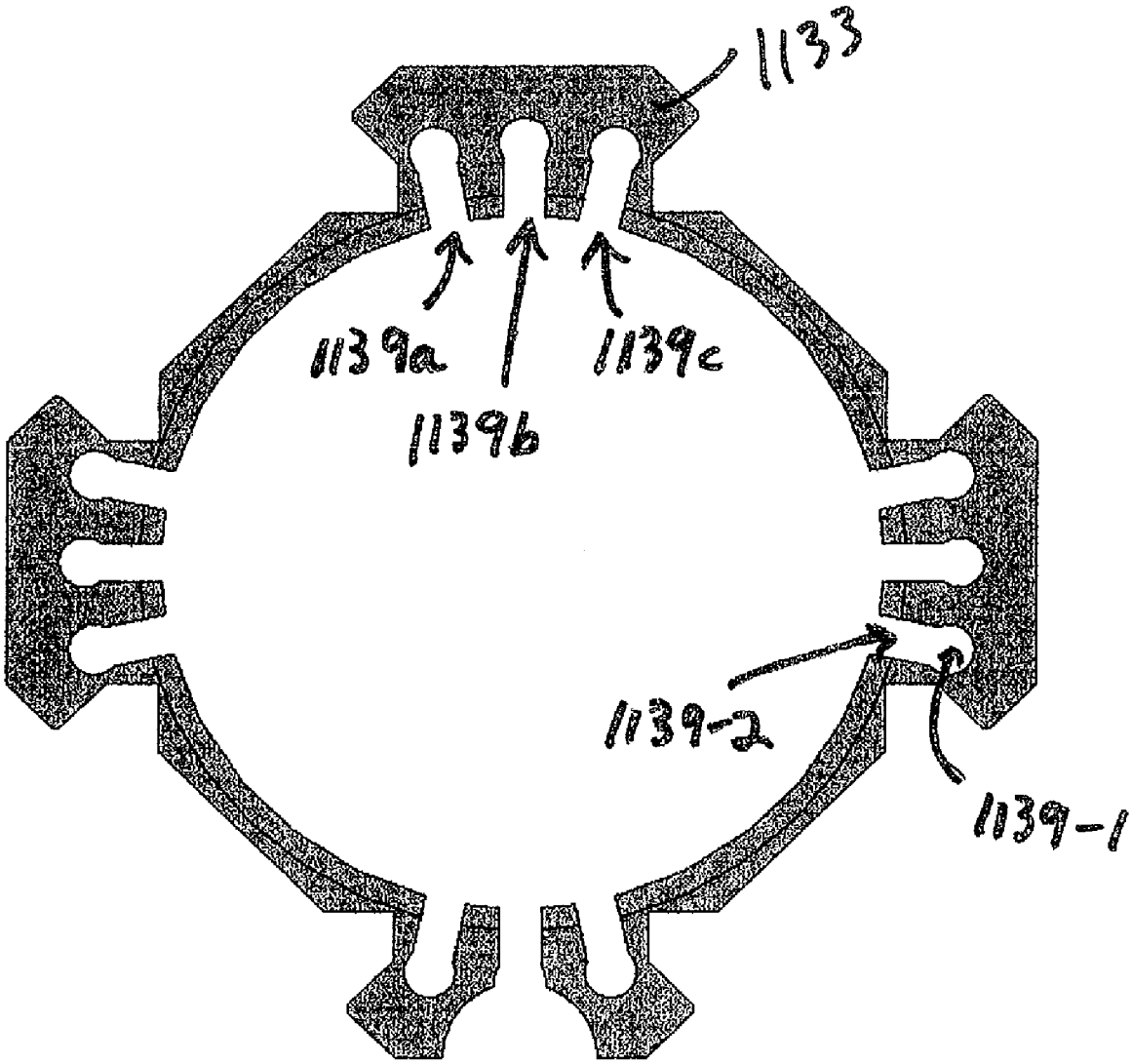

Referring to FIG. 11A, a perspective view of an exemplary embodiment of a rail system is illustrated. As shown in FIG. 11A, rail system 1130 can include a longitudinal unitary tubular body 1138 having a plurality of accessory rails. Each accessory rail includes three conduits 1139. Referring to FIG. 11B, individual conduits 1139*a*, 1139*b*, and 1139*c* can extend from an inner surface of the tubular body to a prescribed radial height in a tab 1133. According to one embodiment, conduits 1139 may have a teardrop shape so that a size of the conduit decreases as it approaches the inner surface of the tubular body. Alternatively, conduits 1139 may include a first portion 1139-1 separated but connected to the inner surface of the tubular body by second portion 1139-2. First portion 1139-1 can be used to route an electrical cable or insulated wire that is introduced to the first portion 1139-1 via second portion 1139-2.

Sizes and cross-sections of first portion 1139-1 and second portion 1139-2 can be varied according to the desired application of rail system 1130. In one embodiment, second portion 1139-2 is larger than first portion 1139-1. In one embodiment, second portion 1139-2 can connect first portion 1139-1 to an outer radial surface of tubular body 1138 or a top surface of tab 1133. Alternatively, first portion 1139-1 can in conduit units 1139*a* or 1139*c* can be connected by second portion 1139-2 to outer side surfaces (e.g., groove 1141, 1142) of tab 1133.

Figure 12:
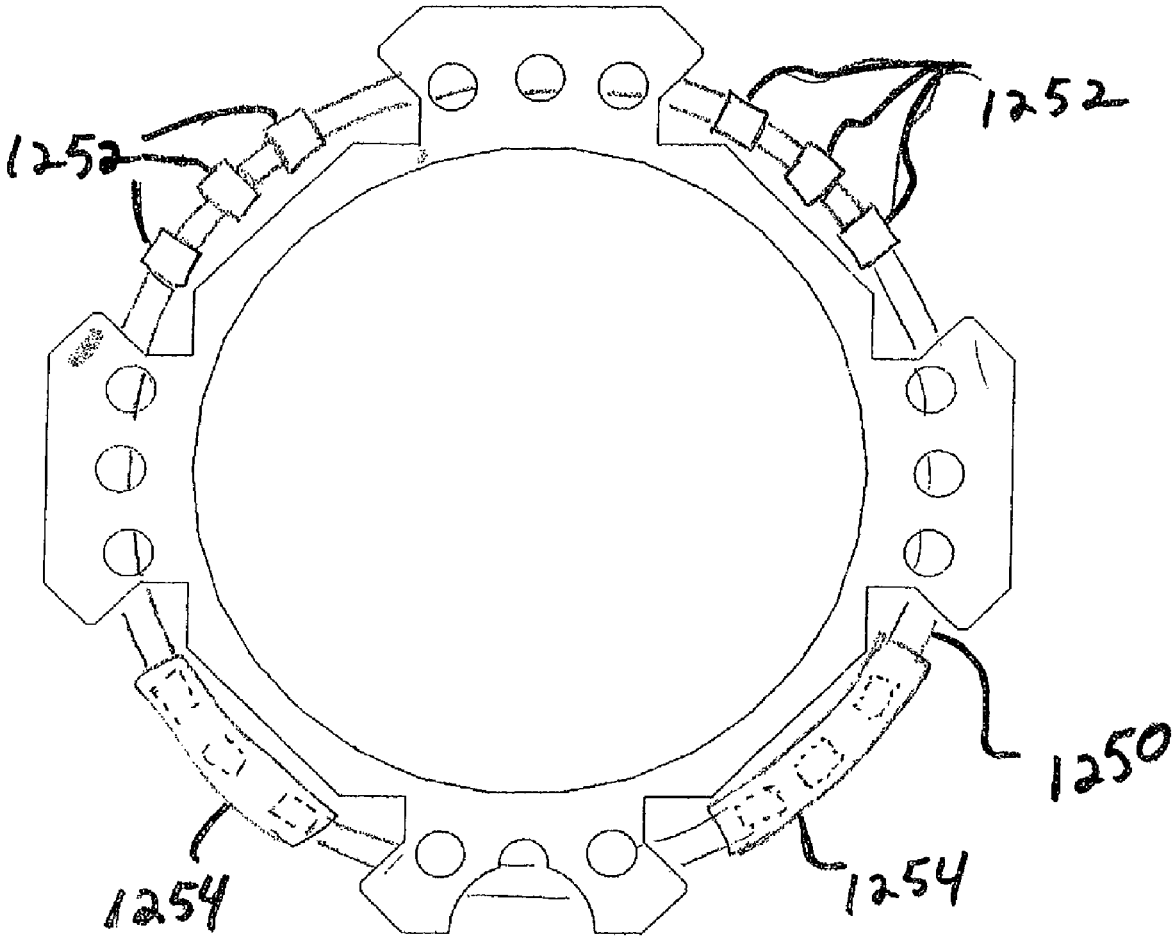
FIG. 12 is a diagram that that shows an exemplary conduit insulator according to an embodiment of the application.

Referring to FIG. 12, a perspective view of an exemplary embodiment of insulating disk 1250 is illustrated. As shown in FIG. 12, insulating disk 1250 is configured to provide insulated access to accessories mounted on accessory rails 32, 34, 36. In one embodiment, insulating disk 1250 can respectively move (e.g., rotate) to accessory rail 32, accessory rail 34, accessory rail 36, etc.

Insulating disk 1250 can be configured with a plurality (e.g., three) of conduit access units 1252 to allow individual access to conduit units 39*a*, 39*b*, 39*c*. In one embodiment, conduit access units 1252 can move between a first position to allow access (e.g., through itself) to a corresponding conduit 39 and a second position to insulate the conduit 39 from access.

Alternatively, insulating disk 1250 can include conduit access unit 1254 that allows concurrent access to a plurality of conduit units 39*a*, 39*b*, 39*c*. In one embodiment, conduit access unit 1254 can move between a first position to allow access (e.g., through itself) to all corresponding conduit units 39*a*, 39*b*, 39*c* at the same time and a second position to insulate all conduit units 39*a*, 39*b*, 39*c* from access.

Insulating disk 1250 can be entirely formed of an insulating material to prevent access to conduits 39 in a corresponding ring of recesses 35 for each of top accessory rail 32, side accessory rails 34, and bottom accessory rail 36. Insulating disk 1250 can have a single conduit access unit 1252, 1254 to allow only a single accessory rail to electrically connect to conduits 39 in a corresponding ring of recesses 35 for each of top accessory rail 32, side accessory rails 34, and bottom accessory rail 36. Embodiments of an insulating disk 1250 can be disposed partially within, entirely within, covering or over corresponding anchor slots 65.

Although grooves 41, 42, and/or 49 are illustrated as a single groove or cut, a plurality of cuts or grooves may be used, for example, to define various surfaces 41*a*, 41*b*. Further, longitudinal grooves 41 and/or 42 can define a plurality of additional external referencing surfaces, for example, a fourth external reference surface can be located between first and second external referencing surfaces 41*a* and 41*b* or 42*a* and 42*b*. Alternatively, additional external referencing surfaces can be below first external referencing surfaces 41*a* or 42*a*.

Although anchor slots 65 are shown as on only all first lateral surfaces 62*a*, embodiments are not intended to be so limited. For example, anchor slots 65 can occur only on a subset of selected first lateral faces 62*a*, or only on a subset of second lateral faces 62*b* both lateral faces 62*a* and 62*b* of at least one identical rib 33 or corresponding opposing lateral face 62*a* of first rib 33 and lateral face 62*b* of second rib 33 that have at least two ribs 33 therebetween.

Although anchor slots 65 are shown having a prescribed site smaller than conduits 39, embodiments are not intended to be so limited. For example, anchor slots 65 may be larger than conduits 39. Further, a size of anchor slots 65 can vary within an accessory rail.

Although anchor slots 65 are shown as substantially extending continuously across a lateral surface of rib 33, embodiments are not intended to be so limited. For example, anchor slots 65 can extend over less than 50% or less than 20% of a lateral face of rib 33. Further for example, anchor slots 65 can be intermittent across rib 33 or in sections having different heights across rib 33.

Although embodiments of the application have been described with respect to electrical power being provided via conduits to mounted accessories, embodiments of the application are not intended to be so limited. For example, mountable accessories (e.g., sensors, cameras, imaging terminals, etc.) that can record and transmit data can be configured to use electrical cabling accessed via recesses 35 or anchor slots 65 to transmit data for storage or display at an accessible terminal of device electrically connected to another point of the cabling provided via conduits in rail systems according to the application.

A small sample of systems methods and apparatus that are described herein.

In one embodiment a rail system assembly can include a tubular body to couple to the firearm over a portion of the barrel in a substantially coaxially and radially spaced relationship; at least one accessory rail at a predetermined position of the tubular body, said at least one rail including a plurality of ribs separated to define opposing lateral surfaces; and at least one groove in a lateral surface of a rib.

In one aspect of a rail system assembly, a front lateral face of at least one rib comprises an anchor slot including said at least one groove. In another aspect, the anchor slot removes a portion of a corresponding rib. In another aspect, the anchor slot removes a portion of a bottom surface of a recess between adjacent ribs. In another aspect, the bottom surface of the recess is curved. In another aspect, selected anchor slots insulatingly intersect at least one longitudinal conduit configured to pass through the plurality of ribs. In another aspect, the anchor slot is configured to include a curved surface, a right angle, a linear surface, a recessed engagement surface, or an engagement shoulder. In another aspect, the anchor slot is configured to operate with an opposing lateral surface to mount an accessory. In another aspect, a plurality of anchor slots includes pairs of corresponding anchor slots in opposing lateral faces of different ribs. In another aspect, the front lateral surface of comprises an additional anchor slot over the anchor slot. In another aspect, a rear lateral surface of at least one rib comprises the groove. In another aspect, said at least one accessory rail comprises a top rail, a bottom rail, or a side rail, and wherein said at least one accessory rail comprises a military-standard-1913 rail. In another aspect, at least one accessory rail comprises opposing longitudinal side grooves, the side grooves to define external reference surfaces for mounting accessories; and a longitudinal central groove between the opposing side grooves, the central groove to define internal reference surfaces for mounting accessories.

In one embodiment an accessory mount for a firearm having a longitudinal barrel can include a longitudinal mount body, said mount body to mount to the firearm in a spaced relationship; a plurality of longitudinally spaced transverse ribs extending along a surface of said mount body; and a recessed engagement surface at a lateral face of at least one transverse rib.

In one aspect of an accessory mount, the mount body comprises an accessory rail to include the plurality of transverse ribs, wherein a front lateral face of each transverse rib comprises an anchor slot including the recessed engagement surface. In another aspect, the recessed engagement surface includes a curved surface, a right angle, a linear surface, or an engagement shoulder, and the recessed engagement surface is configured to operate with an opposing lateral surface to detachably mount an accessory. In another aspect, an engaging surface of an accessory mount is configured to fixedly engage said recessed engagement surface when a corresponding accessory is mounted to the accessory mount.

In one embodiment, a method can include forming a plurality of longitudinally spaced ribs extending along a surface of said mount body; forming rail system assembly for a firearm including the longitudinally spaced ribs; and forming at least one anchor slot in a lateral surface of a rib.

In one embodiment, an accessory mount for a firearm having a longitudinal barrel can include a longitudinal mount body having a front end and a rear end, said mount body to couple to the firearm over a portion of the barrel; longitudinally spaced transverse ribs along said mount body; and a conduit to pass through a plurality of the transverse ribs.

In one aspect of an accessory mount, a power supply unit comprises a first end to connect to a power source exterior to said accessory mount, a second end to connect to an accessory mounted to selected transverse ribs; and an electrical connection unit between said first end and said second end of the power supply unit, the electrical connection unit disposed in the conduit. In another aspect, the electrical connection unit is an insulated wire or an insulated data cable in the conduit. In another aspect, the electrical connection unit is configured to pass through at least ¼ of the transverse ribs, at least ½ of the transverse ribs, at least ¾ of the transverse ribs, or all the transverse ribs. In another aspect, the conduit is accessible in a recess between adjacent transverse ribs. In another aspect, the conduit is insulatingly accessible in an anchor slot in a lateral face of at least one transverse rib. In another aspect, the anchor slot comprises an insulator configured to reciprocate between a first position to insulate the electrical connection unit in the conduit and a second position to allow access to the electrical connection unit in the conduit. In another aspect, the conduit is accessible in selected recesses between said transverse ribs, the accessory mount body comprising insulators in remaining recesses between said transverse ribs to cover corresponding anchor slots in said remaining recesses or bottom surfaces of said remaining recesses. In another aspect, the conduit comprises a plurality of conduit units. In another aspect, each conduit unit is a prescribed radial distance from a top surface of the transverse ribs. In another aspect, each conduit unit passes through different numbers of said transverse ribs. In another aspect, conduit units are configured to extend from the front surface to the rear surface having substantially equal cross-sectional dimensions, wherein a plurality of insulated cables are respectively provided in said conduit units to supply different voltage levels. In another aspect, each conduit unit includes one of a rectangular recessed configuration, a recessed teardrop configuration, an inner mounting surface accessible to an exterior surface of a corresponding transverse rib, or the inner mounting surface with a connecting passage to an exterior surface of the mount body. In another aspect, the conduit includes a recess, a recess configured to extend to an inner radial surface of the transverse ribs, a channel, a through-hole, or an internal channel. In another aspect, the accessory mount comprises at least one accessory rail, said at least one accessory rail comprising a MIL-STD-1913 rail. In another aspect, at least one accessory rail comprises opposing longitudinally extending side grooves adjacent the transverse ribs, the side grooves to define external reference surfaces for mounting accessories; and a longitudinally extending central groove between the side grooves, the central groove to define internal reference surfaces for mounting accessories.

In one embodiment, an accessory mount can include a tubular body mounted over a portion of the barrel substantially coaxially and in a transversely spaced relationship; at least one accessory rail at a predetermined position of the tubular body, said at least one rail including a plurality of longitudinally spaced ribs for mounting an accessory; at least one longitudinal passageway to define an interior surface in a lateral surface of a rib or the tubular body; and an insulated conductive line disposed in the passageway.

In one aspect of an accessory mount an insulated conductive line is configured to supply a voltage or to pass electrical signals representative of data.

In one embodiment a method can include forming a plurality of accessory mount locations extending along a surface of an accessory rail; forming an accessory rail system for a firearm including the accessory rail; and providing an integrated electrical wiring assembly extending within the accessory rail system to pass through the accessory rail to the accessory mount locations.

In one aspect of a method, said forming an accessory rail system and said providing an integrated electrical wiring assembly occur at the same time, wherein the integrated electrical wiring assembly is configured to pass through a plurality of transverse ribs that include the accessory mount locations.

In one embodiment, a method can include extruding a tubular rail system unitary body at least one rail accessory protrusion, said rail system accessory protrusion to extend in a longitudinal direction along an outer radial surface of said tubular rail system unitary body; holding said tubular rail system unitary body stationary; modifying at least one surface of said at least one rail accessory protrusion by moving a material removing device along said at least one surface of said stationary tubular rail system unitary body; rotating said rail system unitary body around a central longitudinal axis; and removing recesses to form opposing lateral faces of adjacent transverse ribs using the material removing device, said material removing device being held stationary during said rotating.

In one aspect of a method said rotating comprises rotating at speeds greater than 200 revolutions per minute or 500 revolutions per minute. In another aspect a bottom surface of a recess between adjacent transverse ribs is a convex curved surface. In another aspect, a lower surface between transverse ribs includes a substantially radially flat surface a prescribed distance from a central longitudinal axis of the tubular rail system unitary body. In another aspect, a depth of bottom surfaces of recesses relative to top surfaces of adjacent transverse ribs increases from a middle region to outer lateral edges. In another aspect, a bottom surface of recesses between adjacent transverse ribs is curved. In another aspect, the method comprises additionally rotating said rail system unitary body around the central longitudinal axis; and removing material in said lateral face of at least one transverse rib to form anchor slots using the material removing device, said material removing device being held stationary during said additionally rotating. In another aspect a plurality of anchor slots include pairs of corresponding anchor slots in opposing lateral faces of separated transverse ribs, additional anchor slots stacked in a single lateral face, said anchors slots in front lateral faces of said transverse ribs, or said anchor slots in rear lateral faces of said transverse ribs. In another aspect, selected anchor slots intersect a plurality of longitudinal conduits that pass through a portion of said at least one transverse rib. In another aspect, the method comprises forming anchor slots in a lateral face of at least one transverse rib. In another aspect, the method comprises forming an accessory rail, wherein said accessory rail satisfies reduced dimensional error tolerances for said recesses, said transverse ribs, or said lateral faces. In another aspect, two or more adjacent recesses are simultaneously formed in a plurality of rail accessory protrusions, or wherein said two or more recesses are formed in one accessory rail protrusion during a rotational period. In another aspect, the method comprises forming a top accessory rail; forming at least one side accessory rail; and forming a bottom accessory rail, said accessory rails comprising military-standard-1913 rails. In another aspect, said modifying at least one surface of said at least one rail accessory protrusion comprises forming longitudinally extending side grooves at opposing sides of said at least one rail accessory protrusion, said side grooves to determine external reference surfaces for mounting accessories; and forming a radial reference surface extending between opposing external reference surfaces; forming a longitudinally extending central groove at said radial referencing surface, said central groove to determine internal reference surfaces for mounting the accessories. In another aspect, the method comprises forming an accessory rail from said at least one rail accessory protrusion; and mounting said accessory rail to a firearm.

In one embodiment, a method of forming an accessory rail system for a firearm can include forming a rail body extending between a first longitudinal end and a second longitudinal end; forming a plurality of slots spaced at a first surface of the rail body; and forming a curved lower surface of each slot.

In one aspect of a method, said curved lower surface is a convex surface extending laterally across said rail body. In another aspect, the method comprises forming a tubular rail system unit including at least one longitudinal rail body; rotating said tubular rail system unit about a central longitudinal axis; and removing material from said at least one rotating rail body using a stationary material removing device during said rotating.

In one embodiment, a rail system assembly for a firearm including a barrel can include a mounting body to couple over a portion of a barrel in a spaced relationship thereto; at least one accessory rail at a predetermined position of the mounting body, said at least one accessory rail including a plurality of ribs spaced by opposing lateral surfaces; and a curved lower surface between at least one pair of adjacent ribs.

In one aspect of a rail system assembly, the curved lower surface is a prescribed radial distance from a central longitudinal axis of the mounting body.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been set forth, it will be understood that features and aspects that have been described with reference to each particular embodiment can be used with each remaining particularly set forth embodiment.

I claim:

1. A rail system assembly for a firearm including a barrel, the rail system assembly comprising:

a tubular body to couple to the firearm over a portion of the barrel in a substantially coaxially and radially spaced relationship;

at least one accessory rail at a predetermined position of the tubular body, said at least one rail including a plurality of ribs separated to define opposing lateral surfaces, the plurality of ribs comprising a first rib and an adjacent rib, wherein a first lateral surface of the first rib faces an opposing lateral surface of the adjacent rib; and a first anchor slot in the first lateral surface of the first rib, wherein the first anchor slot is positioned below a top portion of the first rib, such that the first anchor slot forms an undercut under the too portion of the first rib.

2. The rail system assembly of claim 1, further comprising a second anchor slot in a lateral surface of a second rib, wherein the second anchor slot is positioned below a top portion of the second rib, such that the second anchor slot forms an undercut under the top portion of the second rib.

3. The rail system assembly of claim 2, wherein the first anchor slot and the second anchor slot intersect at least one longitudinal conduit configured to pass through the plurality of ribs.

4. The rail system assembly of claim 2, wherein the first anchor slot and the second anchor slot form a pair of anchor slots in opposing lateral surfaces of the first rib and the second rib.

5. The rail system assembly of claim 1, wherein the first anchor slot removes a portion of the first rib.

6. The rail system assembly of claim 5, wherein the first anchor slot removes a portion of a bottom surface of a recess between the first rib and the adjacent rib.

7. The rail system assembly of claim 6, wherein the bottom surface of the recess is curved.

8. The rail system assembly of claim 1, wherein the first anchor slot is configured to include a curved surface, a right angle, a linear surface, a recessed engagement surface, or an engagement shoulder.

9. The rail system assembly of claim 1, wherein the first anchor slot is configured to operate with the opposing lateral surface of the adjacent rib to mount an accessory.

10. The rail system assembly of claim 1, wherein the first lateral surface comprises an additional anchor slot over the first anchor slot.

11. The rail system assembly of claim 1, wherein a rear lateral surface of the first rib comprises the first anchor slot.

12. The rail system assembly of claim 1, wherein said at least one accessory rail comprises a top rail, a bottom rail, or a side rail, and wherein said at least one accessory rail comprises a military-standard-1913 rail.

13. The rail system assembly of claim 12, wherein said at least one accessory rail comprises:

opposing longitudinal side grooves, the side grooves to define external reference surfaces for mounting accessories; and a longitudinal central groove between the opposing side grooves, the central groove to define internal reference surfaces for mounting accessories.

14. A rail system assembly for a firearm including a barrel, the rail system assembly comprising:

a mounting body to couple over a portion of a barrel in a spaced relationship thereto;

at least one accessory rail at a predetermined position of the mounting body, said at least one accessory rail including a plurality of ribs spaced by opposing lateral surfaces, wherein an opposing lateral surface of one of the ribs faces an opposing lateral surface of an adjacent one of the ribs;

a curved lower surface between at least one pair of adjacent ribs; and at least one anchor slot in an opposing lateral surface of at least one of the ribs in the at least one pair of adjacent ribs, wherein selected anchor slots among a plurality of anchor slots intersect a plurality of longitudinal conduits that pass through a portion of said plurality of ribs.

15. The rail system assembly of claim 14, wherein the curved lower surface is a prescribed radial distance from a central longitudinal axis of the mounting body.

16. The rail system assembly of claim 14, wherein a bottom surface of a recess said plurality of ribs is a convex curved surface.

* * * * *

UNITED STATES PATENT AND TRADEMARK OFFICE

CERTIFICATE OF CORRECTION

PATENT NO. : 8,028,459 B2
APPLICATION NO. : 12/466857
DATED : October 4, 2011
INVENTOR(S) : Nicholas Williams It is certified that error appears in the above-identified patent and that said Letters Patent is hereby corrected as shown below:

At column 13, claim 1, line number 40, delete the word “too” and replace with --top--

At column 14, claim 16, line number 51, delete the words “recess said” and replace with --recess between said--

Signed and Sealed this
Twenty-second Day of November, 2011

David J. Kappos

David J. Kappos
*Director of the United States Patent and Trademark Office*